US010196846B2

(12) United States Patent
Vierke

(10) Patent No.: US 10,196,846 B2
(45) Date of Patent: Feb. 5, 2019

(54) HINGE PIN

(71) Applicant: FORUM US, INC., Houston, TX (US)

(72) Inventor: Andre Vierke, Hamburg (DE)

(73) Assignee: FORUM US, INC., Houston, TX (US)

( * ) Notice: Subject to any disclaimer, the term of this patent is extended or adjusted under 35 U.S.C. 154(b) by 157 days.

(21) Appl. No.: 15/018,305

(22) Filed: Feb. 8, 2016

(65) Prior Publication Data

US 2017/0226785 A1 Aug. 10, 2017

(51) Int. Cl.
*E05D 5/10* (2006.01)
*E05D 3/02* (2006.01)

(52) U.S. Cl.
CPC ..... *E05D 5/10* (2013.01); *E05D 3/02* (2013.01); *E05D 2005/102* (2013.01); *E05Y 2900/608* (2013.01); *Y10T 16/557* (2015.01)

(58) Field of Classification Search
CPC ..... E05D 5/10; E05D 3/02; E05D 2005/102; E05D 11/0081; E05D 11/0018; E05Y 2900/608; Y10T 16/557; Y10T 16/522; Y10T 16/553
USPC ..... 16/386, 223, 380; 439/31, 165
See application file for complete search history.

(56) References Cited

U.S. PATENT DOCUMENTS 1,555,603 A * 9/1925 Overing, Jr. ..... B62D 7/16 16/274
4,839,939 A * 6/1989 O'Brien, II ..... E05D 11/0081 16/223
5,145,076 A * 9/1992 Murphy ..... B61G 3/04 16/386
5,727,960 A * 3/1998 Zehrung ..... E05D 11/0081 16/223
2010/0243314 A1* 9/2010 Bryla ..... E05D 11/0081 174/651

FOREIGN PATENT DOCUMENTS

DE 9200361 U1 3/1992
DE 9410858 U1 9/1994

OTHER PUBLICATIONS

Office Action in corresponding German application 102017102488.3 dated Jun. 13, 2017.

* cited by examiner

*Primary Examiner* — William L Miller
(74) *Attorney, Agent, or Firm* — Patterson + Sheridan LLP

(57) ABSTRACT

A pin according to the present disclosure is configured to connect at least two component parts by engaging, in an engaging direction, in superposed apertures of the component parts. The pin comprises a body having a drilled portion with a borehole extending in the engaging direction, the borehole configured to be at least partially traversed by a securing element, and at least one fixation element for fixing the securing element at the bored portion.

20 Claims, 4 Drawing Sheets

HINGE PIN

BACKGROUND

Field

The present disclosure concerns a hinge pin for connecting at least two component parts.

Description of the Related Art

Composite assemblies are often attached to each other by pins traversing two or more components of a respective assembly. To this end, the components may each include at least one aperture, and they may be connected by positioning the apertures superposed to one another, and by inserting a pin so as to traverse both bores, thereby joining the components. This technique is used, in particular, for assembling hinges.

As a consequence, the pin has to resist divergent forces acting on the different components. In a case of a failure, when the pin breaks, it may slide out of the apertures of the components, thereby dissolving the connection of the components. One or both of the components may thus fall down from a designated position within the assembly, and it may be a laborious task to reinstall the component, if possible at all. Indeed, in many cases, a component may be destroyed or damaged when falling down, so that it has to be replaced. The same may be necessary when the falling component cannot be recovered, e.g. when the component has fallen in the sea, in a well centre or in a mining shaft.

The present disclosure is directed to the problem of providing a technique for obviating these disadvantages.

SUMMARY

The present disclosure generally relates to an apparatus, such as a pin, for connecting at least two component parts. The apparatus includes a body having a borehole formed therein and at least one fixation element. The borehole is configured to be at least partially traversed by a securing element. The fixation element is configured to fix the securing element in the borehole.

A pin according to one embodiment is configured to connect at least two component parts by engaging, in an engaging direction, in respective apertures of the component parts once these apertures have been superposed to each other. The pin comprises a drilled portion with a borehole extending in the engaging direction, the borehole configured to be at least partially traversed by a securing element. Moreover, the pin comprises fixation elements for fixing the securing element at the drilled portion.

The embodiments disclosed herein thus advantageously comprises a drilled (hollow) portion adapted to have the securing element threaded through, wherein the securing element can be fixed at the drilled portion using the fixation elements. Accordingly, when the pin breaks, the pieces thereof can be held together by the securing element. As a consequence, at least in the very most cases, the pieces remain inserted in the apertures of the components, thus connecting the components even in the broken stage of the pin, which inhibits that the components dissolve and fall down.

Depending on the respective utilisation, the pin may have one of various shapes. For instance, it may include at least one section which is essentially prism shaped, preferably holding (or configured to hold) the securing element extending in a longitudinal direction of the prism shaped section (the longitudinal direction thus coinciding with the engaging direction). Accordingly, component parts connected by means of such pin may be joined so as to enclose a fixed angle, whereas pivoting of the component parts pierced by the prism-shaped section is inhibited.

According to one embodiment, the pin may include at least one section which is essentially shaped as a circular cylinder, preferably holding (or configured to hold) the securing element extending in a longitudinal direction (a height) of the cylindrical section (the longitudinal direction thus coinciding with the engaging direction). Such shape allows for a simple insertion of the pin into superposed apertures of the component parts, and it may provide for a pivotable connection of the component parts when they are pierced by the cylindrical section.

According to one embodiment, the cross sectional area (orthogonal to the engaging direction) of the borehole is at most 50% or at most 25% of a cross sectional area (orthogonal to the engaging direction) of the pin. Such relation may avoid that the stability of the pin is unfavourably reduced by the borehole, e.g. in cases where the strain to be applied to the pin is large as related to its diameter.

The pin according to one embodiment can be of one of a wide variety of dimensions. As a particular exemplary embodiment, a cross section (orthogonal to the engaging direction) of the pin has a diameter in a range of at least 0.5 cm and at most 5 cm, preferably in a range of at least 1.5 cm and at most 2.5 cm. According to another exemplary embodiment, a cross section of the pin has a diameter (orthogonal to the engaging direction) in a range between 50 cm and 100 cm.

The borehole may have a cross sectional diameter (orthogonal to the engaging direction) of at least 1 mm, or at least 3 mm, more preferably of at least 5 mm. Additionally or alternatively, the cross sectional diameter may be at most 12 mm, or at most 10 mm, preferably of at most 8 mm. Accordingly, the borehole is wide enough to receive an appropriate securing element, and the pin is strong enough to stably connect the component parts.

According to one embodiment, the pin may include a widened head or flange, which may be arranged at one end (in the engaging direction) of the pin. Such head or flange may provide a blocking for the component parts (once they are pierced by the pin). In one embodiment, the head is formed integrally with the drilled portion (e.g., monolithic and of a same material). Thereby, the head is particularly stable.

The pin may comprise a cotter pin configured to provide a blocking for the component parts, e.g. at a side opposite to a possibly included head or flange. Thereby, the pin is easy to install so as to connect the component parts.

According to one embodiment, the pin may include widened heads and/or flanges at two positions, which are configured to enclose the stacked component parts at both sides thereof, thus providing respective blockings. This is advantageous in particular when the pin includes two or more pin units which may be assembled (e.g. by screwing) after inserting the pin units into the stacked apertures of the component parts.

Indeed, according to one embodiment, the pin may include at least two pin units connectable with each other or (e.g., detachably) connected with each other by some mounting means (such as a screw joint) comprised by at least one of the pin units. Therein, the borehole preferably extends through the at least two pin units. Preferably, such pin includes access means (such as a straining assembly) for straining the securing element after connecting the pin units. The strained securing element may, further to the above mentioned securing of the pin function in a case of breakage, strengthen the connection of the pin units.

According to one embodiment, the fixation elements are configured to fix the securing element at two positions of the drilled portion, the positions configured to encompass stacked portions of the component parts when the pin is used to connect the component parts. For instance, when the component parts each comprise a punched (e.g. ring-like) portion framing the respective superposed aperture, the fixation elements may be configured to fix the securing element at opposite sides of the pins, having the punched portions there between.

Therefore, when the securing element is fixed using the fixation elements, it bridges at least one transition of one component part to the other one. Therefore, the transition region is secured, which transition region is most susceptible within the pin, due to leverage forces applied to the component parts.

According to one embodiment, the fixation elements are inserted into at least one split pin hole; such split pin hole may, for instance, traverse the pin, preferably in a direction inclined to the engaging direction, such as basically orthogonally thereto. The split pin hole may be configured to receive the fixation element, such as a split pin adapted to pass a hole or a loop of the securing element.

Additionally or alternatively, the fixation element may comprise a groove within an interior surface of the drilled portion and/or within an exterior surface of the pin. Such groove (which may yield an enlarged first cross section of the borehole as compared to a second cross section of the borehole) may, for example, be configured to receive a mounting of the securing element. For example, the groove may be provided in an end face of the pin, forming an enlarged entrance of the borehole, adapted to provide a socket for a plate-like cap or base of the securing element. As a further example, the groove may comprise a screw thread adapted to receive, screwed therein, a cap or base of the securing element. Additionally or alternatively, the groove may be positioned at the outer surface of the pin, configured to have a rope of the securing element looped around at least a portion of the pin, or the groove may include a through-hole connecting the groove with the borehole, and it may be adapted to receive a T-piece provided at an end of the securing element, at least a portion of which may be configured to be threaded through the through-hole in the groove.

According to one embodiment, the securing element includes at least one rod, wire, wire rope and/or chain. According to one embodiment, the securing element includes at least one flexible portion. Such flexibility provides for an increased resistance with respect to breakage, even if shearing strains act on the pin.

Preferably, the securing element has a thickness (i.e., a cross sectional diameter orthogonal to the length of the securing element which, when used, traverses the borehole in the engaging direction) of at least 0.5 mm and at most 2.5 mm, more preferably of at least 0.8 mm and at most 1.2 mm. Such diameter provides for a durable and resistant securing element. In particular, its flexibility inhibits bent damages due to shearing forces in a case of pin breakage.

The securing element may or may not be comprised by the pin. In both cases, the fixation elements are configured to fix a securing element of a respective type.

When no securing element is comprised by the pin, due to the fixation elements, the pin nevertheless is configured to cooperate with the securing element once this is inserted and fixed. Thus, the pin may be upgradeable (by inserting and fixing the securing element), so as to provide a secured connection when convenient. Such pin therefore provides the advantage of being applicable for various purposes.

According to one embodiment, the pin is a hinge pin and the at least two component parts the pin is configured to connect are hinges. This embodiment thus provides for an advantageous, secured connection of hinges as elements which are particularly exposed to shearing forces due to the frequent pivoting of such component parts.

A pin according to one embodiment may, in particular, be configured to connect component parts forming parts of a drill floor.

As a particular example, one embodiment concerns a clamping device for use in an oil rig, the clamping device including at least two component parts connected by at least one pin according to one of the embodiments mentioned herein.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

For clarity, identical reference numerals have been used, where applicable, to designate identical elements that are common between figures. Additionally, elements of one embodiment may be advantageously adapted for utilization in other embodiments described herein.

DETAILED DESCRIPTION

Figure 1A:
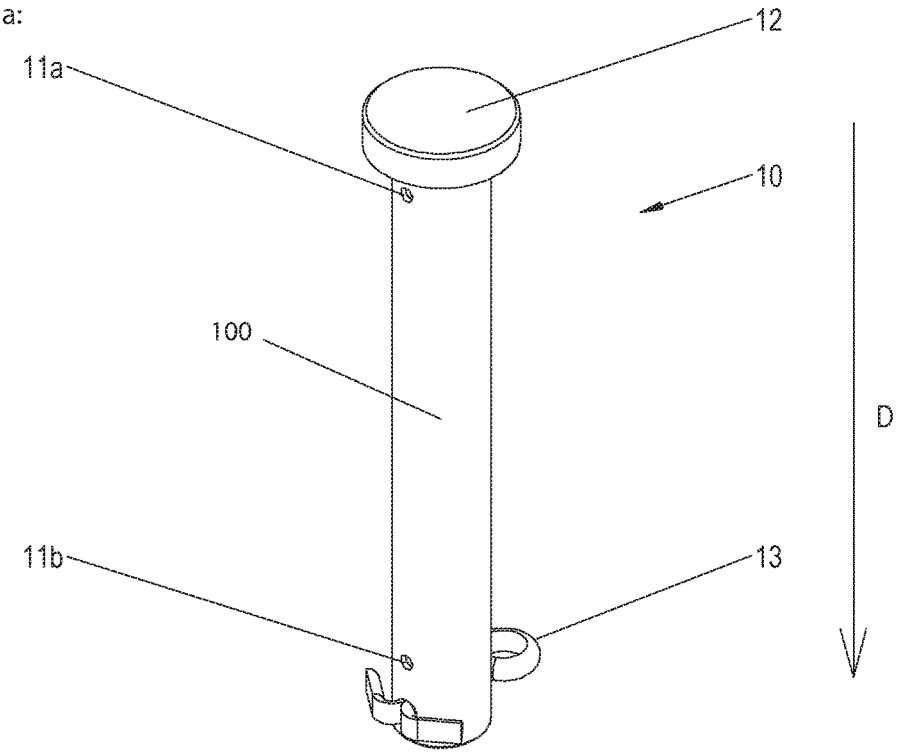
FIG. 1*a* illustrates an exemplary pin, according to one embodiment.

In FIG. 1*a*, an exemplary pin 10 according to one embodiment is shown in perspective view. The pin 10 includes a body 100 shaped as a circular cylinder, and a head 12 having a diameter that is larger than a diameter of the body 100. The head 12 is configured to provide blocking for component parts 30*a*, 30*b* (shown in FIG. 1*b*) when the pin 10 is engaged with the component parts 30*a*, 30*b*. In one embodiment, the head 12 is formed integrally with the body 100, and in another embodiment, the head 12 is coupled to the body 100. In yet another embodiment, the pin 10 includes a head 12 disposed at each end of the body 100. In yet another embodiment, the body 100 of the pin 10 is formed by two or more members (such as pin units) coupled together.

Figure 1B:
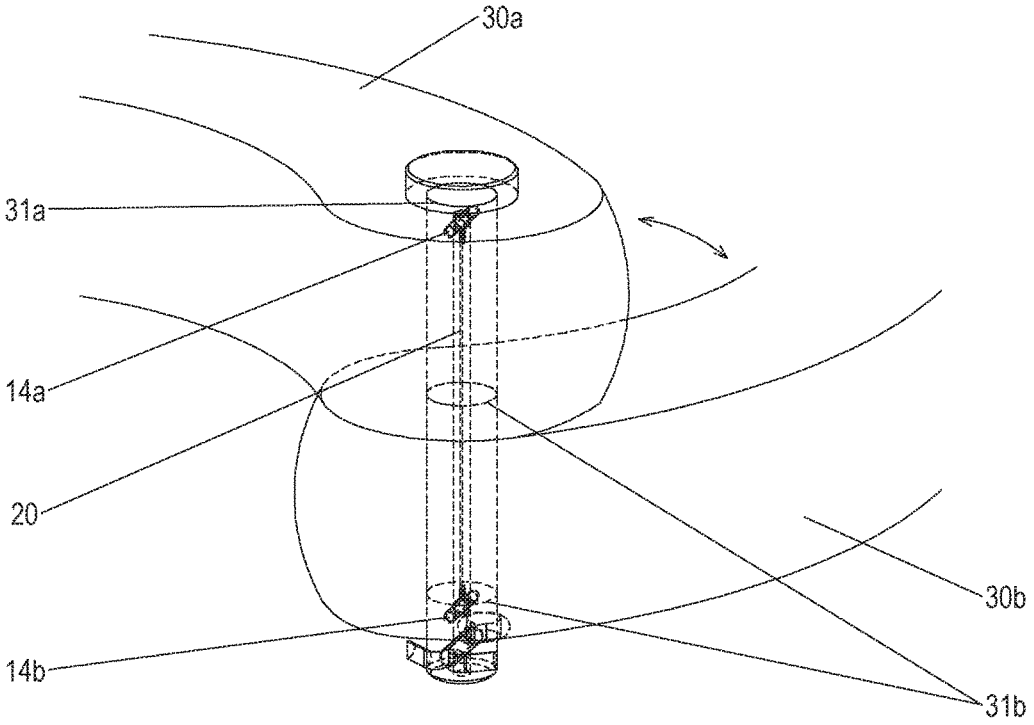
FIG. 1*b* illustrates the pin of FIG. 1*a* connecting two component parts, according to one embodiment.

The pin 10 may further include a cotter pin 13 disposed through the body 100 and configured to secure the pin 10 to one or more component parts as shown in FIG. 1*b*. When the cotter pin 13 is removed from the body 100, the pin 10 can be inserted, in an engaging direction D, in superposed apertures of component parts of appropriate dimension. Thereafter, the cotter pin 13 may be inserted again into the body 100 to prevent removal of the pin 10 from the component parts. The head 12 and the cotter pin 13 then fix the pin 10 within the superposed apertures of the component parts.

Referring to FIGS. 1*a* and 1*b*, the pin 10 further comprises two fixation elements 14*a*, 14*b*, such as split pins, that are disposed within two split pin holes 11*a*, 11*b* formed in the body 100. The fixation elements 14*a*, 14*b* are configured to secure a securing element 20 at two different positions within the body 100 of the pin 10, as shown in FIG. 1*b*. In one embodiment, split pins may be inserted into the split pin holes 11*a*, 11*b* so as to fix, within the body 100 of the pin 10, the securing element 20 as indicated in FIGS. 1*b*, 2*b*, 2*d*. Such split pin holes 11*a*, 11*b* may, for example, traverse the body 100 in a direction orthogonal to the engaging direction D of the pin 10. Between the split pin holes 11*a*, 11*b*, a borehole 15 (as shown in FIG. 2*b*) extends within the body 100 of the pin 10 in the engaging direction D.

FIG. 1*b* illustrates the pin 10 coupling two component parts 30*a*, 30*b* together, according to one embodiment. The two component parts 30*a*, 30*b* each have a respective aperture 31*a*, 31*b* that are superposed with respect to each other and are configured to receive the pin 10. The pin 10 connects component part 30*a* to component part 30*b* by traversing the apertures 31*a*, 31*b* when aligned. The pin 10 has been inserted in the apertures 31*a*, 31*b* and is fixed therein by the head 12 (blocking as the pin 10 passes through) at the one side and by a cotter pin 13 at the other side. The component parts 30*a*, 30*b* may pivot (at least up to a predetermined angle) around the pin 10.

Figure 4:
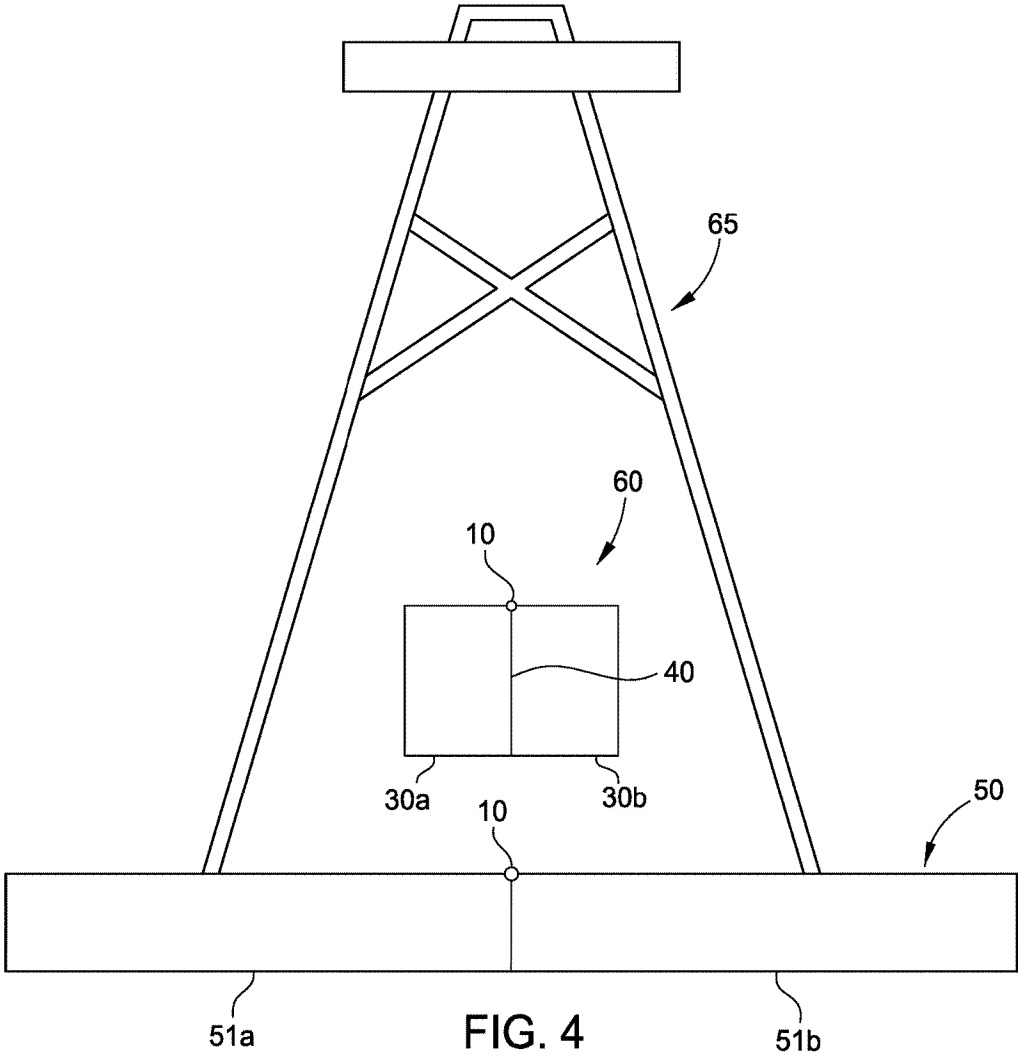
FIG. 4 illustrates examples of the pin when in use.

In one embodiment, the pin 10 is used as a hinge pin and the component parts 30*a*, 30*b* are hinges 40 that are coupled together by the pin 10 as shown in FIG. 4. In another embodiment, the component parts 30*a*, 30*b* form parts 51*a* 51*b* of a drill floor 50 that are coupled together by the pin 10 as shown in FIG. 4. In yet another embodiment, the component parts 30*a*, 30*b* form a clamping device 60 that is coupled together by the pin 10 for use on an oil rig 65 as shown in FIG. 4.

As indicated by dotted lines, fixation elements 14*a*, 14*b*, shown as split pins, have been inserted into the split pin holes 11*a*, 11*b*, respectively. Thereby, the securing element 20 is fixed, the securing element 20 traversing the borehole 15 (shown in FIG. 2*b*) of the pin 10 in the engaging direction D. In the depicted example, the securing element 20 may be a wire or a wire rope, for instance.

Figure 2A:
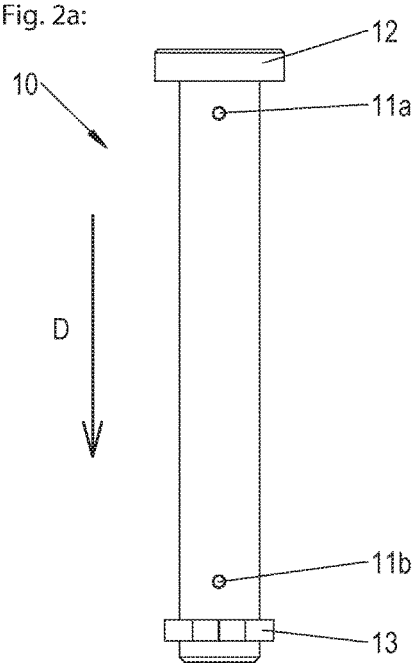
FIG. 2*a* illustrates a side view of the pin of FIG. 1*a*, according to one embodiment.
Figure 2B:
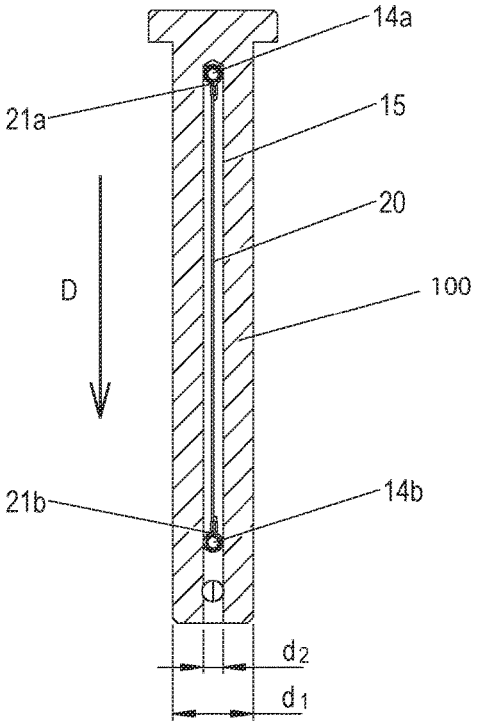
FIG. 2*b* illustrates a longitudinal cross-sectional view of the pin of FIG. 2*a*, according to one embodiment.

In FIGS. 2*a*, 2*b*, a side view and a longitudinal cross section of the pin 10 are shown from a first direction. As can be seen in FIG. 2*b*, the pin 10 includes the borehole 15 extending down along the longitudinal axis of the body 100 in the engaging direction D. The borehole 15 is one-sided, as the pin 10 is closed at its one end by the head 12 and open at the opposite end. As further shown, the body 100 of the pin 10 has diameter $d_1$, and the borehole 15 has a diameter $d_2$. To avoid that the stability of the pin 10 is unfavourably reduced by the borehole 15, in one embodiment $d_2$ is at most the half of $d_1$, resulting in a cross sectional area of the borehole 15 that is at most 25% of a cross sectional area of the body 100 of the pin 10.

In one embodiment, the borehole 15 has a cross-sectional diameter of at least 1 mm. In another embodiment, the borehole 15 has a cross-sectional diameter of at least 3 mm. In yet another embodiment, the borehole 15 has a cross-sectional diameter of at least 5 mm. In one embodiment, the borehole 15 has a cross sectional diameter of at most 8 mm. In another embodiment, the borehole 15 has a cross sectional diameter of at most 10 mm. In yet another embodiment, the borehole 15 has a cross sectional diameter of at most 12 mm. Accordingly, the borehole 15 is wide enough to receive an appropriate securing element 20.

Depending on the respective utilization, the pin 10 may have one of various shapes. In one embodiment, the pin 10 may include at least one section of the body 100 which is essentially prism shaped, and may be configured to hold the securing element 20 extending in a longitudinal direction of the prism shaped section. Accordingly, the component parts 30*a*, 30*b* connected by the pin 10 having a prism shape section of the body 100 may be joined so as to enclose a fixed angle, whereas pivoting of the component parts 30*a*, 30*b* about the prism shaped section is inhibited. In another embodiment, the pin 10 may include at least one section of the body 100 which is essentially shaped as a circular cylinder, and may be configured to hold the securing element 20 extending in a longitudinal direction of the cylindrical section. Such shape allows for a simple insertion of the pin 10 into superposed apertures of component parts 30*a*, 30*b*. The shape of the pin 10 may also provide for a pivotable connection of the component parts 30*a*, 30*b* when the component parts are joined by the cylindrical section of the body 100.

The body 100 of the pin 10 may have a wide variety of dimensions. In one embodiment, the pin 10 has a cross-sectional diameter in the range of 0.5 cm to 5 cm. In another embodiment, the body 100 has a cross-sectional diameter in the range of 1.5 cm to 2.5 cm. According to yet another embodiment, the body 100 has a cross-sectional diameter in the range of 50 cm to 100 cm.

In one embodiment, within the borehole 15, the securing element 20 is fixed by the fixation elements 14*a*, 14*b*, shown as split pins. The split pins engage loops 21*a*, 21*b* of the securing element 20 when the split pins are inserted into the split pin holes 11*a*, 11*b* of the pin 10. The securing element 20 is thereby fixed at two positions by the fixation elements 14*a*, 14*b*, which fixed positions are configured to encompass stacked portions of component parts 30*a*, 30*b* when the pin 10 is connecting the component parts 30*a*, 30*b* together. For example, when the component parts 30*a*, 30*b* each comprises a punched or ring-like portion framing the respective superposed apertures of the component parts 30*a*, 30*b*, the fixation elements 14*a*, 14*b* may be configured to fix the securing element 20 at opposite sides of the body 100 of the pin 10, having the punched portions therebetween. Therefore, when the securing element 20 is fixed by the fixation elements 14*a*, 14*b*, the securing element 20 bridges at least one transition of one component part 30*a* to the second component part 30*b*. Thus, the transition region, which is the most susceptible region within which the pin 10 resides due to leverage forces applied by the component parts 30*a*, 30*b*, is secured.

According to one embodiment, the securing element 20 includes at least one of a rod, a wire, a wire rope, and/or a chain. According to one embodiment, the securing element 20 includes at least one flexible portion. Such flexibility provides for an increased resistance with respect to breakage, even if shearing strains act on the pin 10.

In one embodiment the securing element 20 has a thickness in the range of 0.5 mm to 2.5 mm. In another embodiment, the securing element 20 has a thickness of between 0.8 mm and 1.2 mm. The thickness of the securing element 20 includes the cross-sectional diameter, orthogonal to a length of the securing element 20, which, when used, traverses the borehole 15 in the engaging direction. The diameter provides for a durable and resistant securing element 20. In particular, the flexibility of the securing element 20 inhibits bent damages due to shearing forces in a case of pin breakage.

Figure 3:
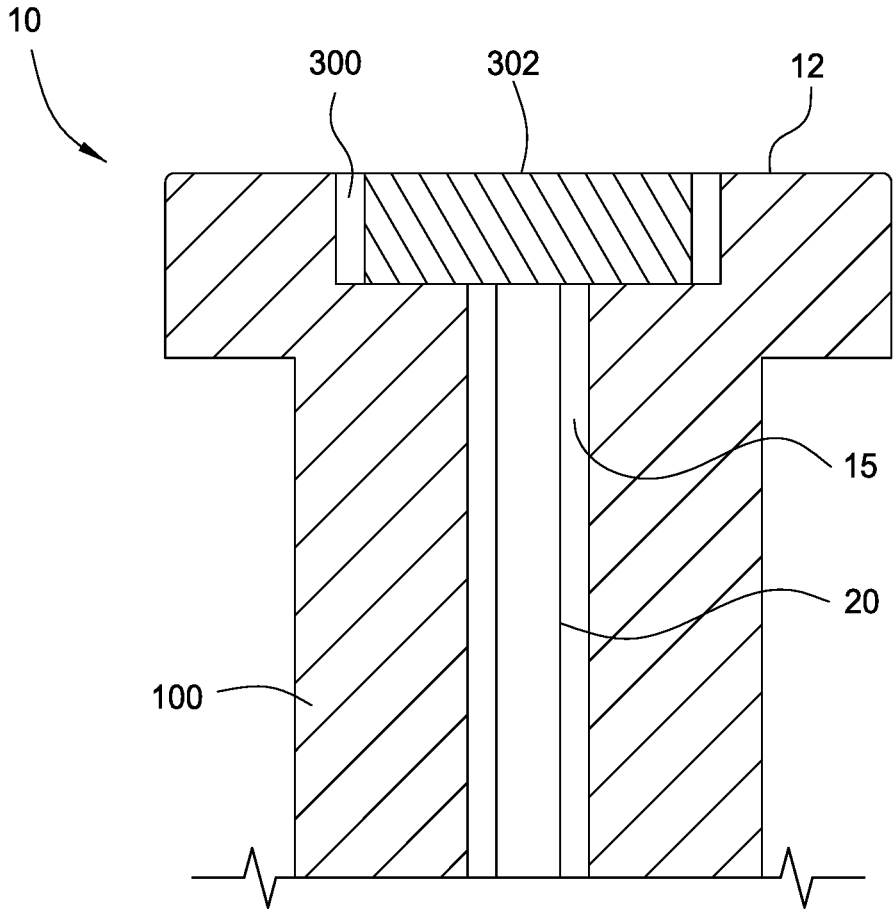
FIG. 3 illustrates the pin of FIG. 1*a*, according to another embodiment.

FIG. 3 illustrates another embodiment of the pin 10, wherein the fixation element may include a groove 300 formed within an interior surface of the borehole 15 and/or an exterior surface of the body 100. The groove 300 may be configured to receive a retainer 302 coupled to the securing element 20. As shown in FIG. 3, the groove 300 may be formed in a top surface of the head 12, thereby forming an enlarged entrance of the borehole 15. The diameter and/or width of the groove 300 and the retainer 302 are greater than the diameter of the borehole 15. The groove 300 is thus adapted to provide a socket for the retainer 302 (such as a plate-like cap or base) of the securing element 20. The top surface of the retainer 302 may be substantially flush with the top surface of the head 12, or alternatively may be recessed below the top surface of the head 12. In another embodiment, the groove 300 may include a screw thread adapted to receive, screwed therein, the retainer 302 of the securing element 20. Additionally, in another embodiment, the groove 300 may be positioned at the outer surface of the body 100 and configured to have a rope of the securing element 20 looped around at least a portion of the body 100. The groove 300 may also include a through-hole connecting the groove 300 with the borehole 15. The through-hole may be adapted to receive a T-piece provided at an end of the securing element 20. At least a portion of the T-piece may be configured to be threaded through the through-hole in the groove.

Figure 2C:
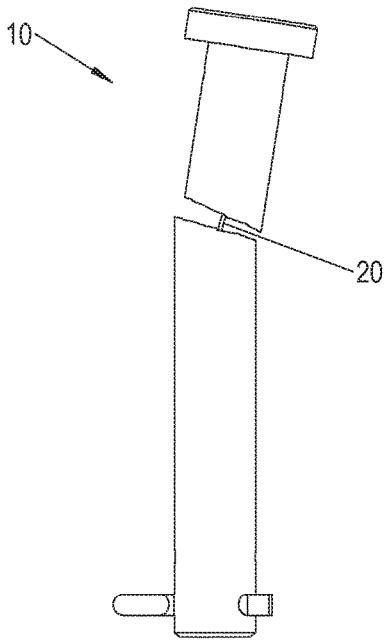
FIG. 2*c* illustrates another side view of the pin shown in FIG. 2*a* in a broken situation when divergent forces act on the pin, according to one embodiment.
Figure 2D:
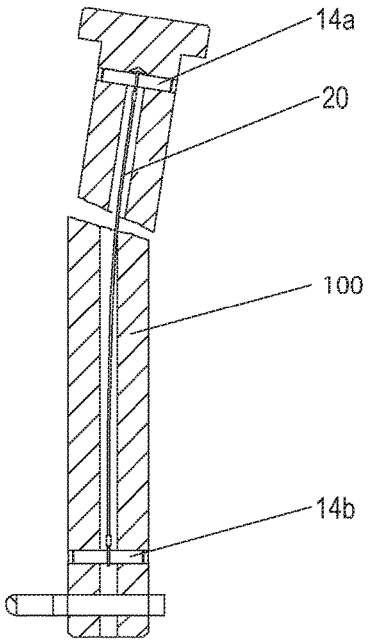
FIG. 2*d* illustrates a longitudinal cross-sectional view of the pin of FIG. 2*c*, according to one embodiment.

FIGS. 2*c* and 2*d* show another side view and a longitudinal cross section of the pin 10 in a situation where the pin 10 is broken. In both FIG. 2*c* and FIG. 2*d*, one or more divergent forces acting on the pin 10 via the component parts 30*a*, 30*b* has resulted in the body 100 of the pin 10 breaking. Due to the securing element 20 in the borehole 15, the pieces of the pin 10 remain connected even in this broken stage. In use, the pin 10 may thus continue to connect component parts 30*a*, 30*b*, inhibiting that one or more of them fall down or otherwise disadvantageously leave a dedicated position.

In one embodiment, the pin 10 and/or the body 100 of the pin 10 may include at least two pin units connectable with each other or (e.g., detachably) connected with each other by a mounting element (such as a screw joint) comprised by at least one of the pin units. The borehole 15 extends through the at least two pin units, and the pin 10 may include a straining assembly for straining the securing element 20 after connecting the pin units. The strained securing element 20 may, further to the above mentioned securing of the pin function in a case of breakage, strengthen the connection of the pin units.

It will be appreciated to those skilled in the art that the preceding examples are exemplary and not limiting. It is intended that all permutations, enhancements, equivalents, and improvements thereto that are apparent to those skilled in the art upon a reading of the specification and a study of the drawings are included within the true spirit and scope of the present disclosure. It is therefore intended that the following appended claims include all such modifications, permutations, and equivalents as fall within the true spirit and scope of these teachings.

I claim:

1. A hinge pin for connecting at least two component parts, comprising:

a body having a borehole formed therein along a longitudinal axis of the body;

a securing element disposed within the borehole, wherein the securing element is secured to the body at a first position and a second position that is longitudinally spaced apart from the first position;

a first fixation element configured to secure the securing element in the borehole at the first position; and a second fixation element configured to secure the securing element in the borehole at the second position, wherein the first and second fixation elements comprise two slip pins configured to fix the securing element at the first and second positions within the borehole.

2. The hinge pin of claim 1, wherein the slip pins are disposed within slip pin holes formed in the body.

3. The hinge pin of claim 1, wherein the securing element includes at least one of a rod, a wire, a wire rope, and a chain.

4. The hinge pin of claim 1, wherein a portion of the body is shaped as a circular cylinder.

5. The hinge pin of claim 1, wherein the borehole has a cross-sectional diameter between about 1 mm and about 12 mm.

6. The hinge pin of claim 1, wherein the securing element has a cross-sectional diameter between about 0.5 mm and about 3 mm.

7. The hinge pin of claim 1, further comprising a cotter pin disposed through the body and configured to couple the hinge pin to the at least two component parts.

8. The hinge pin of claim 1, further comprising a head positioned at an end of the body, wherein the head has a diameter larger than a diameter of the body.

9. The hinge pin of claim 8, wherein the borehole is closed at the end where the head is positioned and is open at the opposite end.

10. The hinge pin of claim 8, wherein at least one of the first and second fixation elements includes a groove formed in a top surface of the head, the groove configured to receive a retainer coupled to the securing element.

11. The hinge pin of claim 10, wherein the groove has a diameter larger than a diameter of the borehole.

12. The hinge pin of claim 1, wherein the body includes one or more members coupled together.

13. The hinge pin of claim 1, wherein the two component parts form part of a drill floor.

14. The hinge pin of claim 1, wherein the two component parts are hinges.

15. The hinge pin of claim 1, wherein the two component parts form a clamping device for use on an oil rig.

16. A hinge pin for connecting at least two component parts, comprising:

a body having a borehole formed therein along a longitudinal axis of the body;

a securing element disposed within the borehole, wherein the securing element is secured to the body at a first position and a second position that is longitudinally spaced apart from the first position;

a first fixation element configured to secure the securing element in the borehole at the first position;

a second fixation element configured to secure the securing element in the borehole at the second position; and a cotter pin disposed through the body and configured to couple the hinge pin to the at least two component parts.

17. A hinge pin for connecting at least two component parts, comprising:

a body having a borehole formed therein along a longitudinal axis of the body;

a securing element disposed within the borehole, wherein the securing element is secured to the body at a first position and a second position that is longitudinally spaced apart from the first position;

a first fixation element configured to secure the securing element in the borehole at the first position; and a second fixation element configured to secure the securing element in the borehole at the second position, wherein the two component parts form part of a drill floor.

18. A hinge pin for connecting at least two component parts, comprising:

a body having a borehole formed therein along a longitudinal axis of the body;

a securing element disposed within the borehole, wherein the securing element is secured to the body at a first position and a second position that is longitudinally spaced apart from the first position;

a first fixation element configured to secure the securing element in the borehole at the first position; and a second fixation element configured to secure the securing element in the borehole at the second position, wherein the two component parts form a clamping device for use on an oil rig.

19. A hinge pin for connecting at least two component parts, comprising:

a body having a borehole formed therein along a longitudinal axis of the body;

a head positioned at an end of the body, wherein the head has a diameter larger than a diameter of the body a securing element disposed within the borehole, wherein the securing element is secured to the body at a first position and a second position that is longitudinally spaced apart from the first position;

a first fixation element configured to secure the securing element in the borehole at the first position; and a second fixation element configured to secure the securing element in the borehole at the second position, wherein at least one of the first and second fixation elements includes a groove formed in a top surface of the head, the groove configured to receive a retainer coupled to the securing element.

20. The hinge pin of claim 19, wherein the groove has a diameter larger than a diameter of the borehole.

* * * * *